US010223955B2

(12) United States Patent
Wang

(10) Patent No.: US 10,223,955 B2
(45) Date of Patent: Mar. 5, 2019

(54) DRIVING CIRCUIT AND LIQUID CRYSTAL DISPLAY APPARATUS

(71) Applicant: SHENZHEN CHINA STAR OPTOELECTRONICS TECHNOLOGY CO., LTD, Guangdong (CN)

(72) Inventor: Mingliang Wang, Guangdong (CN)

(73) Assignee: SHENZHEN CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 203 days.

(21) Appl. No.: 15/308,614

(22) PCT Filed: Jun. 30, 2016

(86) PCT No.: PCT/CN2016/087800
§ 371 (c)(1),
(2) Date: Nov. 3, 2016

(87) PCT Pub. No.: WO2017/206258
PCT Pub. Date: Dec. 7, 2017

(65) Prior Publication Data

US 2018/0061304 A1 Mar. 1, 2018

(51) Int. Cl.
*G09G 3/20* (2006.01)
*G09G 3/36* (2006.01)
*G09G 3/00* (2006.01)

(52) U.S. Cl.
CPC ..... *G09G 3/2092* (2013.01); *G09G 3/006* (2013.01); *G09G 3/36* (2013.01); *G09G 3/3611* (2013.01);
(Continued)

(58) Field of Classification Search
CPC ..... H01L 2924/00; H01L 23/48; H01L 23/49838; H01L 23/50; G09G 2310/08; G09G 3/3648; G09G 2330/025; G09G 2330/026; G09G 2330/04; G09G 3/3696; G09G 2300/0408; G09G 2310/0264; G09G 2330/12; G09G 3/006; G09G 3/2092; G09G 3/36; G09G 3/3611; G02F 2001/136254
See application file for complete search history.

(56) References Cited

U.S. PATENT DOCUMENTS

2010/0123710 A1 5/2010 Lee
2014/0029230 A1* 1/2014 Oh ..... H05K 1/14 361/803
2015/0187317 A1* 7/2015 Seo ..... G09G 3/006 345/212

FOREIGN PATENT DOCUMENTS

CN 101738756 A 6/2010
CN 105096810 A 11/2015
(Continued)

*Primary Examiner* — Hong Zhou
(74) *Attorney, Agent, or Firm* — Mark M. Friedman

(57) ABSTRACT

A driving circuit and a liquid crystal display apparatus are provided. The driving circuit includes a printed circuit board, which includes a timing controller for providing a detection signal to a flexible connector, wherein the detection signal is used for testing connection reliability of the flexible connector, and a power chip tier detecting whether the detection signal returned from the flexible connector is received to obtain a detection result, and controlling power output based upon the detection result.

13 Claims, 2 Drawing Sheets

(52) U.S. Cl.
CPC ..... *G09G 2300/0408* (2013.01); *G09G 2310/0264* (2013.01); *G09G 2310/08* (2013.01); *G09G 2330/12* (2013.01)

(56) References Cited

FOREIGN PATENT DOCUMENTS

| | | | |
|---|---|---|---|
| JP | 2009123525 | A | 6/2009 |
| JP | 2015112726 | A | 6/2015 |

* cited by examiner

DRIVING CIRCUIT AND LIQUID CRYSTAL DISPLAY APPARATUS

FIELD OF THE INVENTION

The present invention relates to the field of display technology, and particularly to a liquid crystal display apparatus and a driving circuit.

BACKGROUND OF THE INVENTION

Currently, with the development of large-size and high-resolution liquid crystal display (LCD) televisions, the size of the connector connecting the driving board with the liquid crystal display panel is becoming larger and larger and the number of terminals is increasing more and more, easily causing the solder skip problem on the terminals located in the middle region of the connector; that is, the terminals of the connector cannot effectively connect the printed circuit board (PCB), and moreover the flexible flat cable (FFC) used together with the connector is becoming wider, making assembly difficult, and causing the FFC to be misalignedly connected, thereby leading to an abnormal display of the display panel, and possibly leading to the burnout of the liquid crystal display panel and the driver chip.

Therefore, it is necessary to provide a driving circuit and a liquid crystal display apparatus for solving the problems in the prior art.

SUMMARY OF THE INVENTION

An object of the present invention is to provide a driver circuit and a liquid crystal display apparatus for resolving the technical problems of solder skip on terminals on the middle area of a flexible connector and the tendency of the damage to display panels and driver chips.

To resolve the above problem, the present invention provides a driving circuit comprising a printed circuit board including:

a timing controller for providing a clock signal for a driver chip and providing a detection signal to a flexible connector; the detection signal being used for testing connection reliability of the flexible connector; and a power chip for detecting whether the detection signal returned from the flexible connector is received, and outputting power when the detection signal returned from the flexible connector is received;

wherein the flexible connector is used for connecting the printed circuit board with the driver chip; and the driver chip is used for providing a driving signal for a liquid crystal display panel.

In the driving circuit of the present invention, when the power chip receives the detection signal returned from the flexible connector, the connection of the flexible connector is determined to be reliable.

In the driving circuit of the present invention, the driver chip includes a source driver chip and a gate driver chip, the source driver is used for providing a data signal for a liquid crystal display panel, and the gate driver chip is used for providing a scan signal for the liquid crystal display panel.

In the driving circuit of the present invention, the detection signal is transmitted from a first end of the first connecting portion to a third end of the second connecting portion, transmitted from the third end of the second connecting portion to a first middle part of the second connecting portion, transmitted from the first middle part of the second connecting portion to a third middle part of the first connecting portion, transmitted from the third middle part of the first connecting portion to a fourth middle part of the first connecting portion, transmitted from the fourth middle part of the first connecting portion to a second middle part of the second connecting portion, and then transmitted from the second middle part of the second connecting portion to a second end of the first connecting portion.

To resolve the above problem, the present invention provides a driving circuit comprising a printed circuit board including a driving circuit comprising a printed circuit board including:

a timing controller for providing a detection signal to a flexible connector; the detection signal being used for testing connection reliability of the flexible connector; and a power chip for detecting whether the detection signal returned from the flexible connector is received to obtain a detection result, and controlling power output based upon the detection result;

wherein the flexible connector is used for connecting the printed circuit board with a driver chip; and the driver chip is used for providing a driving signal for a liquid crystal display panel.

In the driving circuit of the present invention, when receiving the detection signal returned from the flexible connector, the power chip outputs power.

In the driving circuit of the present invention, when the power chip receives the detection signal returned from the flexible connector, the connection of the flexible connector is determined to be reliable.

In the driving circuit of the present invention, the timing controller further provides a clock signal for the driver chip.

In the driving circuit of the present invention, the driver chip includes a source driver chip and a gate driver chip, the source driver is used for providing a data signal for a liquid crystal display panel, and the gate driver chip is used for providing a scan signal for the liquid crystal display panel.

In the driving circuit of the present invention, the detection signal is transmitted from a first end of the first connecting portion to a third end of the second connecting portion, transmitted from the third end of the second connecting portion to a first middle part of the second connecting portion, transmitted from the first middle part of the second connecting portion to a third middle part of the first connecting portion, transmitted from the third middle part of the first connecting portion to a fourth middle part of the first connecting portion, transmitted from the fourth middle part of the first connecting portion to a second middle part of the second connecting portion, and then transmitted from the second middle part of the second connecting portion to a second end of the first connecting portion.

The present invention further provides a liquid crystal display apparatus, comprising a backlight module;

a liquid crystal display panel including a plurality of data lines, a plurality of scan lines, and a plurality of pixel units defined by the data lines and the scan lines, and a driving circuit including a printed circuit board including:

a timing controller for providing a detection signal to a flexible connector; the detection signal being used for testing connection reliability of the flexible connector; and a power chip for detecting whether the detection signal returned from the flexible connector is received to obtain a detection result, and controlling power output based upon the detection result;

wherein the flexible connector is used for connecting the printed circuit board with a driver chip; and the driver chip is used for providing a driving signal for the liquid crystal display panel.

In the liquid crystal display panel of the present invention, when receiving the detection signal returned from the flexible connector, the power chip outputs power.

In the liquid crystal display panel of the present invention, when the power chip receives the detection signal returned from the flexible connector, the connection of the flexible connector is determined to be reliable.

In the liquid crystal display panel of the present invention, the timing controller further provides a clock signal for the driver chip.

In the liquid crystal display panel of the present invention, the driver chip includes a source driver chip and a gate driver chip, the source driver is used for providing a data signal for a liquid crystal display panel, and the gate driver chip is used for providing a scan signal for the liquid crystal display panel.

In the liquid crystal display panel of the present invention, the detection signal is transmitted from a first end of the first connecting portion to a third end of the second connecting portion, transmitted from the third end of the second connecting portion to a first middle part of the second connecting portion, transmitted from the first middle part of the second connecting portion to a third middle part of the first connecting portion, transmitted from the third middle part of the first connecting portion to a fourth middle part of the first connecting portion, transmitted from the fourth middle part of the first connecting portion to a second middle part of the second connecting portion, and then transmitted from the second middle part of the second connecting portion to a second end of the first connecting portion.

The driving circuit and the liquid crystal display device of the present invention transmit the detection signal to the flexible connector by the timing controller generating the detection signal, and detect whether the detection signal returned from the flexible connector is received to obtain a detection result, and controlling power output based upon the detection result, thereby preventing the abnormal display and the panel burnout.

DETAILED DESCRIPTION OF THE PREFERRED EMBODIMENTS

Figure 1:
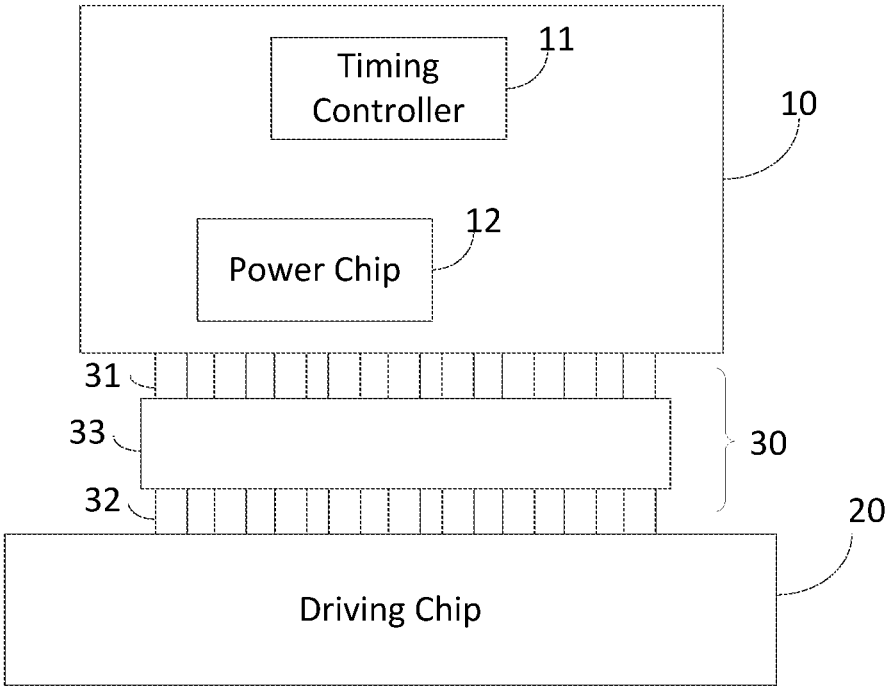
FIG. 1 (Prior Art)
FIG. 1 is a structural schematic diagram of a driving circuit in a prior art.

The following description of the embodiments with reference to the accompanying drawings is used to illustrate particular embodiments of the present invention. The directional terms referred in the present invention, such as "upper", "lower", "front", "back", "left", "right", "inner", "outer", "side surface", etc. are only directions with regard to the accompanying drawings. Therefore, the directional terms used for describing and illustrating the present invention are not intended to limit the present invention. In the drawings, units with similar structures are indicated by the same reference number.

Please refer to FIG. 1, which is a structural schematic diagram of a driving circuit in a prior art.

As shown in FIG. 1, a conventional liquid crystal panel driving circuit includes a printed circuit board 10, a driver chip 20, and a flexible connector 30. The printed circuit board 10 includes a timing controller 11 (TCON) and a power chip 12. The timing controller 11 is used for providing a driving signal for display. The power chip 12 is used for supplying power. The flexible connector 30 includes an upper connecter 31, a lower connecter 32, and a flexible flat cable 33 (FTC) positioned between the upper connecter 31 and the lower connecter 32. The printed circuit board is connected with the driving chip 20 through the flexible connector 30, thereby transmitting the driving signal and the power signal generated by the printed circuit board to the driver chip through the flexible connector.

However, when the size of the connector connecting the driving board with the liquid crystal display panel becomes larger, the number of terminals increases. Furthermore, the flexible connector is designed as an elongated rectangle, so a slight bend easily causes the pins located on the middle region to be solder skip, and causes the display signal and the power signal to be abnormally transmitted. Moreover, as the size of the flexible connector becomes larger, it also causes the flexible flat cable (FFC) to be wider, and to be easily misalignedly connected upon assembling, easily leading to the risk of an abnormal display and panel burnout.

Figure 2:
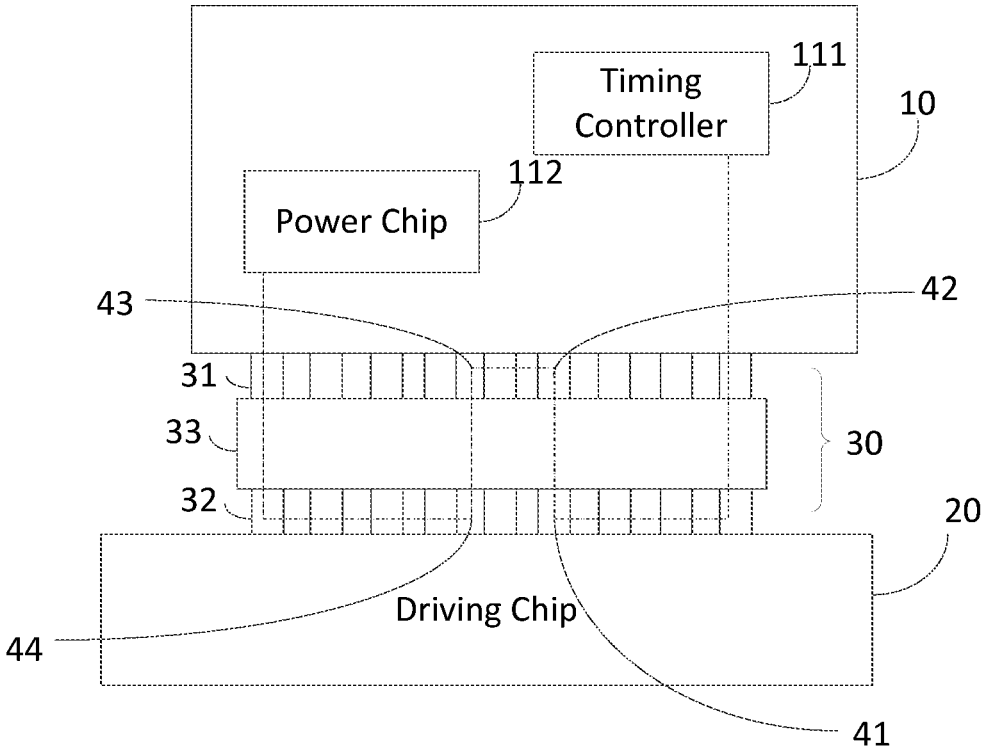
FIG. 2 is a structural schematic diagram of a driving circuit of the present invention.

Please refer to FIG. 2, which is a structural schematic diagram of a driving circuit of the present invention.

As shown in FIG. 2, the driving circuit of the liquid crystal panel of the present invention includes a printed circuit board 10, a drive chip 20, and a flexible connector 30. The printed circuit board. 10 includes a timing controller 111 and a power chip 112. The printed circuit 10 board is connected with the driving chip 20 through the flexible connector 30, thereby transmitting the driving signal and the power signal generated by the printed circuit board to the driver chip through the flexible connector. The driver chip 20 is used for providing a driving signal for the liquid crystal display panel. The driving signal may include a data signal and a scan signal.

The difference between the present embodiment and the driving circuit of FIG. 1 is that the timing controller 111 of the present embodiment is used for providing a detection signal to the flexible connector 30. The detection signal is used for testing the connection reliability of the flexible connector. The power chip 112 is used for detecting whether the detection signal returned from the flexible connector 30 is received to obtain a detection result, and controlling power output based upon the detection result.

In order to improve the detection efficiency, the flexible connector includes a first connecting portion 31 (upper connector), a second connecting portion 32 (lower connector), and a flexible flat cable 33 (FFC) positioned between the upper connecter 31 and the lower connecter 32. The first connecting portion 31 connects the printed circuit board 10, and the second connecting portion 32 connects the driver chip 20.

Specifically, the transmission route of the detection signal is as shown by the dotted line in FIG. 2. The detection signal is transmitted from the first end of the first connecting portion (the right-most pin of the upper connector) to the third end of the second connecting portion (the right-most pin of the lower connector), transmitted from the third end of the second connecting portion to the first middle part 41 of the second connecting portion, transmitted from the first middle part 41 of the second connecting portion to a third middle part 42 of the first connecting portion, transmitted from the third middle part 42 of the first connecting portion to a fourth middle part 43 of the first connecting portion, transmitted from the fourth middle part 43 of the first connecting portion to a second middle part 44 of the second connecting portion, and then transmitted from the second middle part 44 of the second connecting portion to a second end of the first connecting portion (the left-most pin of the upper connector).

A control signal is generated by the timing controller 111. The control signal may be transmitted from the right-most pin of the upper connector to the lower connector via the ITC, then transmitted to the left-most pin of the upper connector via the middle pins of the lower connector, and finally transmitted to the power chip (IC) via the left-most pin of the upper connector. Specifically, the transmission route of the detection signal is as shown by the dotted line in FIG. 2.

Only when the transmission route is unimpeded can the power chip receive the returned detection signal; otherwise, the power chip cannot receive the detection signal. When the power chip receives the control signal, the power chip outputs power; when the power chip does not receive the control signal, the power chip does not output power. Since when any solder skip phenomenon appears or the FFC is misalignedly connected, the detection signal cannot be normally transmitted to the power chip, thereby, no power is outputted, the serious consequence of burnout is prevented.

Preferably, when receiving the detection signal returned from the flexible connector 30, the power chip 112 outputs power. Therefore, by the detection signal detecting the connection reliability of the flexible reliability, when the pins of the flexible connector are solder skip or are misalignedly connected, the power chip cannot receive the detection signal, and the power chip does not output power; when the pins of the flexible connector are not solder skip or are not misalignedly connected, the power chip can receive the detection signal, and the power chip outputs power, preventing the abnormal display and the panel burnout.

Preferably, when the detection signal returned from the flexible connector 30 is received, the connection of the flexible connector 30 is determined to be reliable, that is, the pins of the flexible connector are not solder skip or the FTC is not misalignedly connected.

Preferably, the timing controller 111 is also used for providing a clock signal for the driver chip 20. The clock signal is used for generating the corresponding driving signal.

The driver chip includes a source driver chip. The source driver is used for providing a data signal for a liquid crystal display panel.

The driver chip includes a gate driver chip. The gate driver chip is used for providing a scan signal for the liquid crystal display panel.

The driving circuit and the liquid crystal display device of the present invention transmit the detection signal to the flexible connector by the timing controller generating the detection signal, and detect whether the detection signal returned from the flexible connector is received to obtain a detection result, and controlling power output based upon the detection result, thereby preventing an abnormal display and panel burnout, and reducing the production cost.

The present invention also provides a liquid crystal display apparatus, which includes a backlight module, a liquid crystal display panel, and a driving circuit. The liquid crystal display panel includes a plurality of data lines, a plurality of scan lines, and a plurality of pixel units defined by the data lines and the scan lines. As shown in FIG. 2, the driving circuit of the liquid crystal panel of the present invention includes a printed circuit board 10, a drive chip 20, and a flexible connector 30. The printed circuit board 10 includes a timing controller 111 and a power chip 112. The printed circuit 10 board is connected with the driving chip 20 through the flexible connector 30, thereby transmitting the driving signal and the power signal generated by the printed circuit board to the driver chip through the flexible connector. The driver chip 20 is used for providing a driving signal for the liquid crystal display panel. The driving signal may include a data signal and a scan signal.

The difference between the present embodiment and the driving circuit of FIG. 1 is that the timing controller 111 of the present embodiment is used for providing a detection signal to the flexible connector 30. The detection signal is used for testing the connection reliability of the flexible connector. The power chip 112 is used for detecting whether the detection signal returned from the flexible connector 30 is received to obtain a detection result, and controlling power output based upon the detection result.

In order to improve the detection efficiency, the flexible connector includes a first connecting portion 31 (upper connector), a second connecting portion 32 (lower connector) and a flexible flat cable 33 (FFC) positioned between the upper connecter 31 and the lower connecter 32. The first connecting portion 31 connects the printed circuit board 10, and the second connecting portion 32 connects the driver chip 20.

Specifically, the transmission route of the detection signal is as shown by the dotted line in FIG. 2. The detection signal is transmitted from the first end of the first connecting portion (the right-most pin of the upper connector) to the third end of the second connecting portion (the right-most pin of the lower connector), transmitted from the third end of the second connecting portion to the first middle part 41 of the second connecting portion, transmitted from the first middle part 41 of the second connecting portion to a third middle part 42 of the first connecting portion, transmitted from the third middle part 42 of the first connecting portion to a fourth middle part 43 of the first connecting portion, transmitted from the fourth middle part 43 of the first connecting portion to a second end 44 of the second connecting portion, and then transmitted from the second end 44 of the second connecting portion to a second end of the first connecting portion (the left-most pin of the upper connector).

A control signal is generated by the timing controller 111. The control signal may be transmitted from the right-most pin of the upper connector to the lower connector via the FFC, then transmitted to the left-most pin of the upper connector via the middle pins of the lower connector, and finally transmitted to the power chip (IC) via the left-most pin of the upper connector. Specifically, the transmission route of the detection signal is as shown by the dotted line in FIG. 2.

Only when the transmission route is unimpeded can the power chip receive the returned detection signal, otherwise, the power chip cannot receive the detection signal. When the power chip receives the control signal, the power chip outputs power; when the power chip does not receive the control signal, the power chip does not output power. Since when any solder skip phenomenon appears or the FTC is misalignedly connected, the detection signal cannot be normally transmitted to the power chip, thereby, no power is outputted, the serious consequence of burnout is prevented.

Preferably, when receiving the detection signal returned from the flexible connector 30, the power chip 112 outputs power. Therefore, by the detection signal detecting the connection reliability of the flexible reliability, when the pins of the flexible connector are solder skip or are misalignedly connected, the power chip cannot receive the detection signal, and the power chip does not output power; when the pins of the flexible connector are not solder skip or are not misalignedly connected, the power chip can receive the detection signal, and the power chip outputs power, preventing the abnormal display and the panel burnout.

Preferably, when the detection signal returned from the flexible connector 30 is received, the connection of the flexible connector 30 is determined to be reliable, that is, the pins of the flexible connector are not solder skip or the FTC is not misalignedly connected.

Preferably, the timing controller 111 is also used for providing a clock signal for the driver chip 20. The clock signal is used for generating the corresponding driving signal.

The driver chip includes a source driver chip. The source driver is used for providing a data signal for a liquid crystal display panel.

The driver chip includes a gate driver chip. The gate driver chip is used for providing a scan signal for the liquid crystal display panel.

The driving circuit and the liquid crystal display device of the present invention transmit the detection signal to the flexible connector by the timing controller generating the detection signal, and detect whether the detection signal returned from the flexible connector is received to obtain a detection result, and controlling power output based upon the detection result, thereby preventing an abnormal display and panel burnout, and reducing the production cost.

In summary, although the preferable embodiments of the present invention have been disclosed above, the embodiments are not intended to limit the present invention. A person of ordinary skill in the art, without departing from the spirit and scope of the present invention, can make various modifications and variations. Therefore, the scope of the invention is defined in the claims.

What is claimed is:

1. A driving circuit comprising:

a printed circuit board including:

a timing controller for providing a clock signal for a driver chip and providing a detection signal to a flexible connector; the detection signal being used for testing connection reliability of the flexible connector; and a power chip for detecting whether the detection signal returned from the flexible connector is received, and outputting power when the detection signal returned from the flexible connector is received;

wherein the flexible connector is used for connecting the printed circuit board with the driver chip; and the driver chip is used for providing a driving signal for a liquid crystal display panel;

wherein the flexible connector includes a first connecting portion, a second connecting portion, and a flexible flat cable positioned between the first connecting portion and the second connecting portion; the printed circuit board is connected with the driver chip through the flexible connector; the first connecting portion is located between the printed circuit board and the flexible flat cable; the second connecting portion is located between the flexible flat cable and the driver chip;

wherein a first end of the first connecting portion to is electrically connected to a first end of the second connecting portion, the first end of the second connecting portion is electrically connected to a first middle part of the second connecting portion, the first middle part of the second connecting portion is electrically connected to a first middle part of the first connecting portion, the first middle part of the first connecting portion is electrically connected to a second middle part of the first connecting portion, the second middle part of the first connecting portion is electrically connected to a second middle part of the second connecting portion, the second middle part of the second connecting portion is electrically connected to a second end of the first connecting portion.

2. The driving circuit as claimed in claim 1, wherein when the power chip receives the detection signal returned from the flexible connector, the connection of the flexible connector is determined to be reliable.

3. The driving circuit as claimed in claim 1, wherein the driver chip includes a source driver chip and a gate driver chip, the source driver is used for providing a data signal for a liquid crystal display panel, and the gate driver chip is used for providing a scan signal for the liquid crystal display panel.

4. A driving circuit comprising:

a printed circuit board including:

a timing controller for providing a detection signal to a flexible connector; the detection signal being used for testing connection reliability of the flexible connector; and a power chip for detecting whether the detection signal returned from the flexible connector is received to obtain a detection result, and controlling power output based upon the detection result;

wherein the flexible connector is used for connecting the printed circuit board with a driver chip; and the driver chip is used for providing a driving signal for a liquid crystal display panel;

wherein the flexible connector includes a first connecting portion, a second connecting portion, and a flexible flat cable positioned between the first connecting portion and the second connecting portion; the printed circuit board is connected with the driver chip through the flexible connector; the first connecting portion is located between the printed circuit board and the flexible flat cable; the second connecting portion is located between the flexible flat cable and the driver chip;

wherein a first end of the first connecting portion to is electrically connected to a first end of the second connecting portion, the first end of the second connecting portion is electrically connected to a first middle part of the second connecting portion, the first middle part of the second connecting portion is electrically connected to a first middle part of the first connecting portion, the first middle part of the first connecting portion is electrically connected to a second middle part of the first connecting portion, the second middle part of the first connecting portion is electrically connected to a second middle part of the second connecting portion, the second middle part of the second connecting portion is electrically connected to a second end of the first connecting portion.

5. The driving circuit as claimed in claim 4, wherein when receiving the detection signal returned from the flexible connector, the power chip outputs power.

6. The driving circuit as claimed in claim 4, wherein when the power chip receives the detection signal returned from the flexible connector, the connection of the flexible connector is determined to be reliable.

7. The driving circuit as claimed in claim 4, wherein the timing controller further provides a clock signal for the driver chip.

8. The driving circuit as claimed in claim 4, wherein the driver chip includes a source driver chip and a gate driver chip, the source driver is used for providing a data signal for a liquid crystal display panel, and the gate driver chip is used for providing a scan signal for the liquid crystal display panel.

9. A liquid crystal display apparatus, comprising:

a backlight module;

a liquid crystal display panel including a plurality of data lines, a plurality of scan lines, and a plurality of pixel units defined by the data lines and the scan lines, and a driving circuit including a printed circuit board including:

a timing controller for providing a detection signal to a flexible connector;

the detection signal being used for testing connection reliability of the flexible connector; and a power chip for detecting whether the detection signal returned from the flexible connector is received to obtain a detection result, and controlling power output based upon the detection result;

wherein the flexible connector is used for connecting the printed circuit board with a driver chip; and the driver chip is used for providing a driving signal for the liquid crystal display panel;

wherein the flexible connector includes a first connecting portion, a second connecting portion, and a flexible flat cable positioned between the first connecting portion and the second connecting portion; the printed circuit board is connected with the driver chip through the flexible connector; the first connecting portion is located between the printed circuit board and the flexible flat cable; the second connecting portion is located between the flexible flat cable and the driver chip;

wherein a first end of the first connecting portion to is electrically connected to a first end of the second connecting portion, the first end of the second connecting portion is electrically connected to a first middle part of the second connecting portion, the first middle part of the second connecting portion is electrically connected to a first middle part of the first connecting portion, the first middle part of the first connecting portion is electrically connected to a second middle part of the first connecting portion, the second middle part of the first connecting portion is electrically connected to a second middle part of the second connecting portion, the second middle part of the second connecting portion is electrically connected to a second end of the first connecting portion.

10. The driving circuit as claimed in claim 9, wherein when receiving the detection signal returned from the flexible connector, the power chip outputs power.

11. The driving circuit as claimed in claim 9, wherein when the power chip receives the detection signal returned from the flexible connector, the connection of the flexible connector is determined to be reliable.

12. The driving circuit as claimed in claim 9, wherein the timing controller further provides a clock signal for the driver chip.

13. The driving circuit as claimed in claim 9, wherein the driver chip includes a source driver chip and a gate driver chip, the source driver is used for providing a data signal for a liquid crystal display panel, and the gate driver chip is used for providing a scan signal for the liquid crystal display panel.

* * * * *